US005423489A

United States Patent [19]

Wood

[11] Patent Number: 5,423,489

[45] Date of Patent: Jun. 13, 1995

[54] FUEL INJECTOR HAVING AN INTERNAL FILTER

[75] Inventor: Ross W. Wood, Newport News, Va.

[73] Assignee: Siemens Automotive L.P., Auburn Hills, Mich.

[21] Appl. No.: 75,007

[22] Filed: Jun. 10, 1993

Related U.S. Application Data

[63] Continuation of Ser. No. 847,145, Mar. 5, 1992, abandoned.

[51] Int. Cl.[6] ..... B05B 1/14; B05B 1/30

[52] U.S. Cl. ..... 239/575; 239/585.1; 239/DIG. 23

[58] Field of Search ..... 239/575, 585.1, DIG. 23, 239/553.3, 553.5; 210/429, 430

[56] References Cited

U.S. PATENT DOCUMENTS 2,874,001 2/1959 Webb ..... 239/553.3
4,923,169 5/1990 Grieb et al. ..... 239/585.1

*Primary Examiner*—Andres Kashnikow
*Assistant Examiner*—Lesley D. Morris
*Attorney, Agent, or Firm*—George L. Boller; Russel C. Wells

[57] ABSTRACT

A filter is disposed internally of the fuel injector between the inlet and the internal valve so that particulate material having an internal origin may also be prevented from reaching the injector's valve. The filter is an electroformed screen that is supported within the fuel injector's nozzle end and is sandwiched against an internal shoulder of the fuel injector.

18 Claims, 2 Drawing Sheets

FUEL INJECTOR HAVING AN INTERNAL FILTER

This is a continuation of application Ser. No. 07/847,145 filed on Mar. 5, 1992 now abandoned.

THE FIELD OF THE INVENTION

This invention relates to electromechanical actuated fuel injectors of the type used in the fuel systems of spark-ignited internal combustion engines.

BACKGROUND AND SUMMARY OF THE INVENTION

It is known to provide such a fuel injector with an external filter means disposed to filter the fuel as it approaches the fuel injector's inlet. While such a filter is suitable for preventing particulate material in fuel from entering the fuel injector, it is incapable of filtering particulate material that may originate internally of the fuel injector either on account of processes used to manufacture and assemble the fuel injector or on account of usage.

The present invention relates to an improvement that enables a filter to be disposed internally of the fuel injector between the inlet and the internal valve means so that particulate material having an internal origin may also be prevented from reaching the valve means.

Although it is known to provide certain mechanical fuel injectors with flow geometries intended to filter particulate material of external origin, insofar as the applicant is aware the issue of filtering particulate material that originates internally of an electromechanical actuated gasoline, or flex fuel, fuel injector has not been successfully addressed. Such fuel injectors are typically manufactured in special environments using special processes to eliminate sources of contamination inside the finished product. Particulate material can originate within such a fuel injector due to manufacturing processes and/or from inadequate cleaning of component parts prior to assembly. Internal particulate material can originate from any assembly tooling, gauging, or air borne matter which becomes trapped inside the fuel injector prior to assembly of the external filter at the fuel injector inlet. Elimination of sources of internal contamination has historically been controlled only through special manufacturing processes, special techniques, and parts inspection.

The present invention is not intended to eliminate the need to maintain certain process controls used to avoid the inclusion of particulate material in the finished fuel injector. The invention is, however, intended to possibly minimize the intensity of inspection that may be required of the fuel injector and its component parts during assembly and thus more efficiently satisfy requirements against internal contamination.

Briefly, the present invention comprises in a general way the incorporation of an internal filter element in close proximity to the fuel injector's valve means. Thus, any particulate material greater than a certain size and originating internally of the fuel injector either after assembly or during use of the fuel injector will be prevented from reaching the internal valve means and thus possibly interfering with the proper functioning of the fuel injector. The preferred embodiment of the invention comprises for the filtering element an electroformed metal filter screen element. A preferred embodiment of the invention applied to a particular fuel injector will be disclosed and in this embodiment the arrangement is especially advantageous because of the manner in which the filter element is associated with the individual component parts of that particular fuel injector. Principles of the invention are, however, applicable to embodiments of gasoline, or flex fuel, fuel injectors other than the particular embodiment that is disclosed herein.

Further features, advantages and benefits of the invention, along with those already mentioned, will be seen in the ensuing description and claims which should be considered in conjunction with the accompanying drawings. The drawings illustrate a presently preferred embodiment of the invention according to the best mode contemplated at this time for carrying out the invention.

DESCRIPTION OF THE PREFERRED EMBODIMENT

Figure 1:
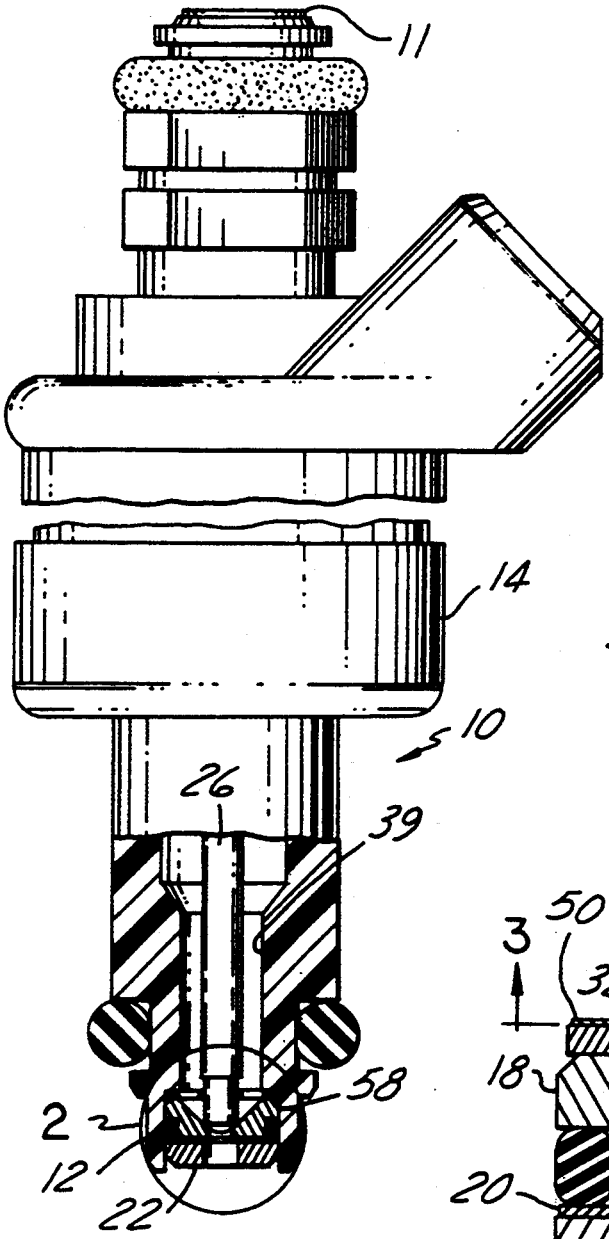
FIG. 1 is a longitudinal view having portions broken away of an electromechanical actuated gasoline, or flex fuel, fuel injector containing a filter element according to principles of the present invention.
Figure 2:
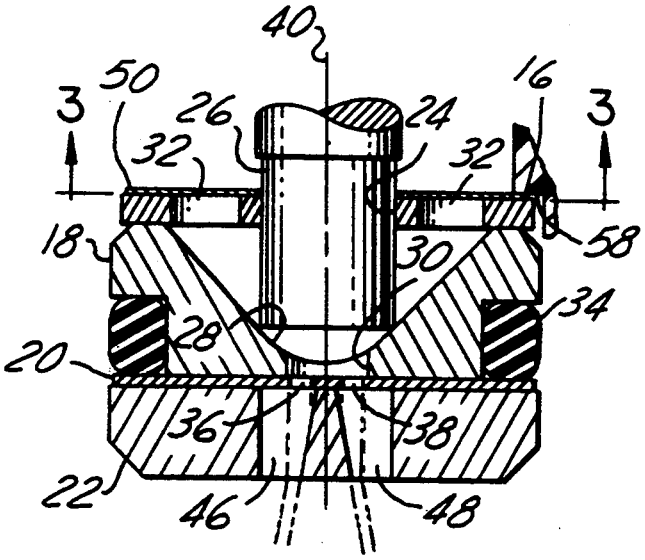
FIG. 2 is an enlarged view in circle 2 of FIG. 1.

FIG. 1 shows an electromechanical actuated fuel injector 10 which has an inlet 11 at one longitudinal end and a nozzle 12 at the opposite longitudinal end. The injection of fuel from nozzle 12 is controlled by the selective energization and de-energization of an electromagnetic coil 14. Details of the nozzle end of the fuel injector can be seen in FIG. 2.

Mounted on the nozzle end are a guide member 16, a seat member 18, a thin disc orifice member 20, and a split stream flow director member 22. Extending through guide member 16 is a central circular guide hole 24 for accurately guiding a circular cylindrical needle 26 for longitudinal reciprocal motion with respect to a seat 28 that is centrally formed in seat member 18. Needle 26 is reciprocated in response to the energization and de-energization of coil 14. Guide member 16 is joined to seat member 18 such that hole 24 is longitudinally aligned with seat 28. Needle 26 has a rounded tip end shown seated on seat 28 when coil 14 is de-energized to close a central circular hole 30 that extends from the bottom of seat 28 through seat member 18. When coil 14 is energized, needle 26 is displaced upwardly to unseat its rounded tip end from seat 28 so as to open hole 30. When the coil is again de-energized, the needle moves downwardly to reseat its rounded tip end on seat 28 to thereby once again close hole 30. Thus the needle and seat constitute the internal valve means of the fuel injector.

Guide member 16 has a number of through-holes 32 spaced outwardly of hole 24 to allow fuel to pass through the guide member. There are six such circular through-holes uniformly circumferentially spaced around the guide member. An elastomeric O-ring 34 is disposed in a groove around seat member 18 to seal between the seat member and the wall of the fuel injector nozzle end. Thin disc orifice member 20 comprises two circular orifices 36,38 that perform fuel splitting and metering functions. Split stream flow director member 22 comprises two holes 46,48 arranged to deflect flow streams from orifices 36,38. This much of the fuel injector that has been mentioned under this Description of the Preferred Embodiment is like that disclosed in the applicant's commonly assigned U.S. Pat. No. 5,016,819. The fuel flow passage 39 through the injector extends longitudinally from inlet 11 to nozzle 12.

Figure 3:
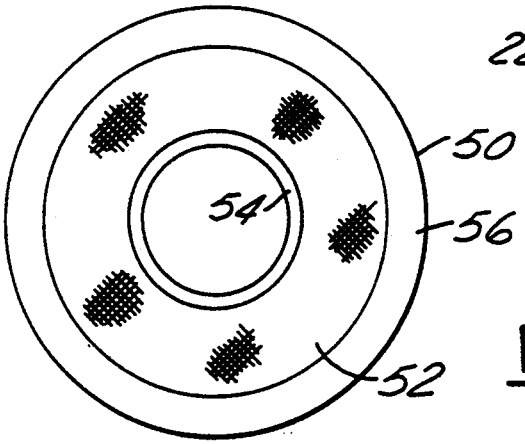
FIG. 3 is a view looking in the direction of arrow 3 in FIG. 2.
Figure 4:
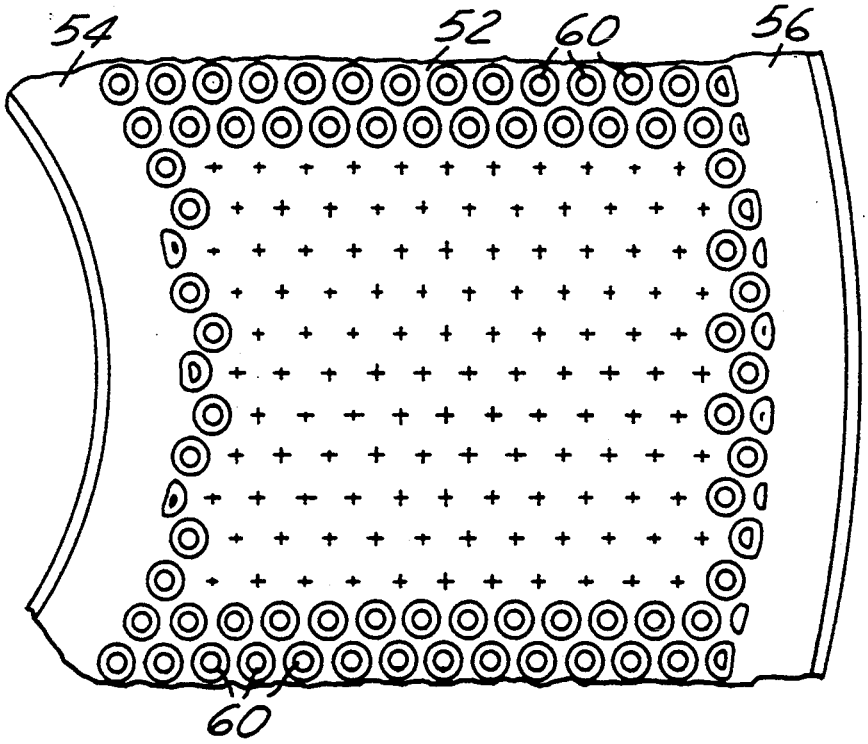
FIG. 4 is an enlarged view of a portion of FIG. 3.
Figure 5:
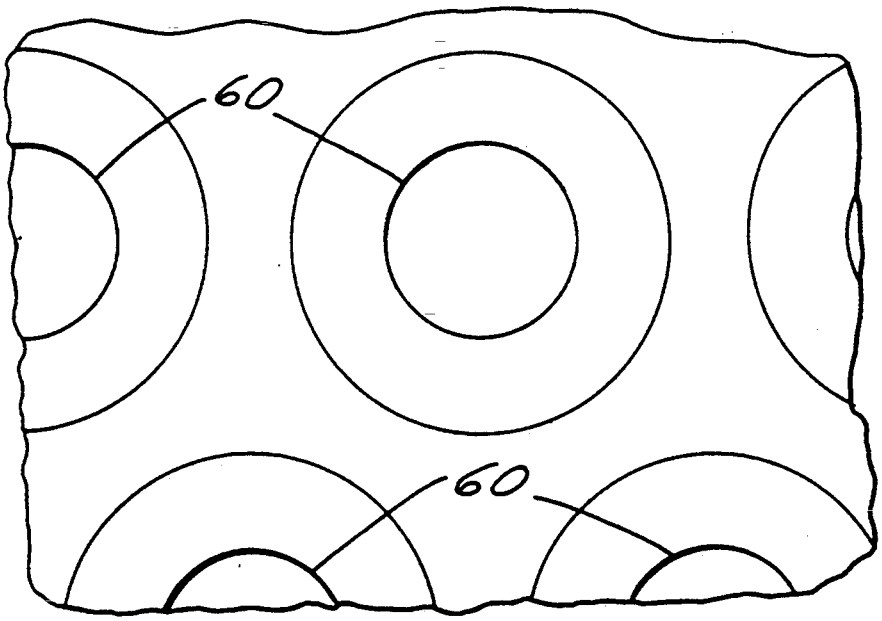
FIG. 5 is an enlarged view of a portion of FIG. 4.

The present invention comprises the inclusion of a filter screen element 50, which is disposed on the upstream face of guide member 16. Details of filter screen element 50 can be seen in FIGS. 3–5. Filter screen element 50 has a circular annular shape comprising a circular inside diameter and a circular outside diameter. It is also flat, having a uniform thickness. The filter screen element comprises an annular filtering zone 52 that is disposed between an inner annular imperforate zone 54 and an outer annular imperforate zone 56. The filter screen element is secured in assembly on the fuel injector by the outer margin of zone 56 being sandwiched by guide member 16 directly against an internal shoulder 58 of the fuel injector nozzle end which face the direction toward which fuel is injected. Filtering zone 52 overlies the six circular through-holes 32 in guide member 16 so that fuel passing through through-holes 32 is first filtered by the filter element. Because of the fuel pressure, it is actually unnecessary for the inner margin of the filter element's inner zone 54 to be joined to the corresponding inner margin of member 16, but actual attachment could be performed if desired. With the injector flowing fuel, the minimal pressure drop across the filter element is sufficient to maintain the filter element in place against member 16 even though the only mechanical attachment is by means of the sandwiching force acting to sandwich the outer margin of the filter element between shoulder 58 and member 16. The diameter of through-hole 24 is selected to provide a very close running clearance fit of member 16 to the outside diameter (O.D.) of needle 26. The size of this clearance presents to the fluid a very high resistance flow path that is in parallel with the much less restrictive flow path through the series combination of perforate zone 52 and through-holes 32. As a result there is essentially no flow through the extremely small annular clearance that exists between needle 26 and through-hole 24. Moreover, the diametral clearance between needle 26 and through-hole 24 is much less than the size of the diameter of each individual through-hole in perforate zone 52. In view of these features, particulate material that is intended to be filtered by the filter element is prevented from by-passing perforate zone 52, without the necessity of attaching the inner margin of filter screen element to member 16 and without the need for extremely close control of the filter screen element's I.D. Therefore essentially all the flow to the internal valve means is through the through-holes 32, and that flow is filtered by the filter screen element.

Because the filter screen element is disposed in close proximity to, but upstream of, the internal valve means, it is capable of filtering particulate material that is introduced into the fuel injector at any point upstream of the filter whether the particulate material is introduced with fuel entering inlet 11 or originates internally of the fuel injector.

The particular filter element is non-woven stainless steel having a generally uniform thickness throughout. It is fabricated by known electroforming (electroplating) technology. The representative filter element comprises a thickness in the range from about 50 microns to about 100 microns. The filtering zone 52 is perforate and comprises a multitude of through-holes 60 which are arranged in a desired pattern to provide a suitable open area. In the illustrated embodiment shown enlarged in FIGS. 4 and 5, the pattern is a hexagon one such that each hole is equally distant from its immediately adjacent ones. Each through-hole has an area substantially equivalent to that of a 50 micron diameter circle. The open area is from about 15% to about 30% of the total annular area of zone 52.

A filter element of this character is provided with suitable backup support by virtue of the fact that it is disposed against the upstream face of member 16. The holes in member 16 are neither sufficiently large nor sufficiently spaced closely together to deprive the filtering zone 52 of adequate backup support, and thus it is kept substantially flat throughout. The parts 50, 16, 18, 20, and 22 are assembled into the fuel injector via its nozzle end whose edge is thereafter crimped to capture the parts in assembly.

The electroforming processing produces holes that are substantially circular in transverse cross-section but these holes may be endowed with a very slight taper. Because of this, it is preferred that the filter element be disposed in the fuel injector such that the taper narrows in the flow direction. Moreover, the total net flow area through the filtering zone 52 overlying the underlying holes in member 16 is such that the inclusion of the filter element imposes negligible pressure drop. This is important because the inclusion of the filter should not impair the proper metering functions that are provided by the fuel injector.

While a presently preferred embodiment of the invention has been illustrated and described, it is to be appreciated that principles of the invention may be embodied in other ways that are equivalent to the following claims.

What is claimed is:

1. A fuel injector comprising a fuel inlet at which pressurized fuel is introduced into the fuel injector, selectively energizable and de-energizable electromechanical actuator means controlling the opening and closing of an internal valve means within the fuel injector, said actuator means comprising a member that is axially reciprocated in response to the energization and de-energization of said electromechanical actuator means to open and close said valve means, a nozzle at which fuel is injected from the fuel injector in accordance with the opening and closing of said internal valve means, and filter means disposed internally of the fuel injector downstream of said fuel inlet and upstream of said valve means for filtering particulate material from fuel before it reaches said internal valve means, support means providing downstream back-up support of said filter means, said support means and said filter means comprising respective central through-holes through which said member passes, said support means comprising additional through-hole means which is covered by said filter means and through which fuel passes to said internal valve means, and said central through-hole of said support means having close running clearance to said member such that the size of said clearance imposes a substantially greater restriction to flow than the restriction imposed by said additional through-hole means so as to cause essentially all fuel flow to pass through said additional through-hole means, said filter means having a radially outer margin via which it is secured on the fuel injector and a radially inner margin that is unsecured.

2. A fuel injector as set forth in claim 1 in which said filter means comprises a non-woven electroformed metal filter screen element that has been grown to a substantially flat uniform thickness throughout.

3. A fuel injector comprising a fuel inlet at which pressurized fuel is introduced into the fuel injector, Selectively energizable and de-energizable electromechanical actuator means controlling the opening and closing of an internal valve means within the fuel injector, said actuator means comprising a member that is axially reciprocated in response to the energization and de-energization of said electromechanical actuator means to open and close said valve means, a nozzle at which fuel is injected from the fuel injector in accordance with the opening and closing of said internal valve means, and filter means disposed internally of the fuel injector downstream of said fuel inlet and upstream of said valve means for filtering particulate material from fuel before it reaches said internal valve means, support means providing downstream back-up support of said filter means, said support means and said filter means comprising respective central through-holes through which said member passes, said support means comprising additional through-hole means which is covered by said filter means and through which fuel passes to said internal valve means, and said central through-hole of said support means having close running clearance to said member such that the size of said clearance imposes a substantially greater restriction to flow than the restriction imposed by said additional through-hole means so as to cause essentially all fuel flow to pass through said additional through-hole means, in which said filter means comprises a non-woven electroformed metal filter screen element that has been grown to a substantially flat uniform thickness throughout, said filter screen element has an outer peripheral margin that is sandwiched between an internal shoulder of said nozzle and said support means, said filter screen element has a limited area in registry with said additional through-hole means, and said limited area consists of an open area portion and a closed area portion, said open area portion comprising a multitude of through-holes each of which has an area effective to filter a certain sized particulate material.

4. A fuel injector as set forth in claim 3 in which said limited area is within an annular band of said filter screen element containing such through-holes throughout, said annular band is radially inwardly bounded by an imperforate annular inner band and radially outwardly bounded by an imperforate annular outer band, and the latter annular band is sandwiched between said shoulder and said support means.

5. A fuel injector as set forth in claim 3 in which said filter screen element has a thickness in the range from about 50 microns to about 100 microns.

6. A fuel injector as set forth in claim 3 in which said multitude of through-holes comprises through-holes arranged in a hexagon pattern such that each is equidistant from its immediately adjacent ones.

7. A fuel injector as set forth in claim 3 in which said multitude of through-holes comprises through-holes each having an area equivalent substantially to that of a 50 micron diameter circle.

8. A fuel injector as set forth in claim 3 in which said open area is in a range of from about 15% of said limited area to about 30% of said limited area.

9. A fuel injector as set forth in claim 3 in which said filter screen element has a thickness in the range from about 50 microns to about 100 microns, said multitude of through-holes comprises through-holes arranged in a hexagon pattern such that each is equidistant from its immediately adjacent ones, said multitude of through-holes comprises through-holes each having an area equivalent substantially to that of a 50 micron diameter circle, and said open area is in a range of from about 15% of said limited area to about 30% of said limited area.

10. A fuel injector comprising a fuel inlet at which pressurized fuel is introduced into the fuel injector, selectively energizable and de-energizable electromechanical actuator means controlling the opening and closing of an internal valve means within the fuel injector, a nozzle at which fuel is injected from the fuel injector in accordance with the opening and closing of said internal valve means, and filter means disposed internally of the fuel injector downstream of said fuel inlet and upstream of said valve means and comprising a filtering zone for filtering particulate material from fuel before it reaches said internal valve means, support means providing support of said filter means, said support means comprising through-hole means which is covered by said filtering zone and through which fuel passes to said internal valve means, said filtering zone comprises a non-woven electroformed metal filter screen element that has been grown to a substantially fiat uniform thickness throughout, and said filter screen element has a thickness in the range from about 50 microns to about 100 microns.

11. A fuel injector as set forth in claim 10 in which said filter screen element comprises a multitude of through-holes arranged in a hexagon pattern such that each is equidistant from its immediately adjacent ones.

12. A fuel injector comprising a fuel inlet at which pressurized fuel is introduced into the fuel injector, selectively energizable and de-energizable electromechanical actuator means controlling the opening and closing of an internal valve means within the fuel injector, a nozzle at which fuel is injected from the fuel injector in accordance with the opening and closing of said internal valve means, and filter means disposed internally of the fuel injector downstream of said fuel inlet and upstream of said valve means and comprising a filtering zone for filtering particulate material from fuel before it reaches said internal valve means, support means providing support of said filter means, said support means comprising through-hole means which is covered by said filtering zone and through which fuel passes to said internal valve means, said filtering zone comprises a non-woven electroformed metal filter screen element that has been grown to a substantially flat uniform thickness throughout, said filter screen element comprises a multitude of through-holes arranged in a hexagon pattern such that each is equidistant from its immediately adjacent ones, and said multitude of through-holes comprises through-holes each having an area equivalent substantially to that of a 50 micron diameter circle.

13. A fuel injector comprising a fuel inlet at which pressurized fuel is introduced into the fuel injector, selectively energizable and de-energizable electromechanical actuator means controlling the opening and closing of an internal valve means within the fuel injector, a nozzle at which fuel is injected from the fuel injector in accordance with the opening and closing of said internal valve means, and filter means disposed internally of the fuel injector downstream of said fuel inlet and upstream of said valve means and comprising a filtering zone for filtering particulate material from fuel before it reaches said internal valve means, support means providing support of said filter means, said supped means comprising through-hole means which is covered by said filtering zone and through which fuel passes to said internal valve means, and said filtering zone comprises a non-woven electroformed metal filter screen element that has been grown to a substantially fiat uniform thickness throughout, and said filter screen element has an open area in a range of from about 15% of its total area to about 30% of its total area.

14. A fuel injector comprising a fuel inlet at which pressurized fuel is introduced into the fuel injector, selectively energizable and de-energizable electromechanical actuator means controlling the opening and closing of an internal valve means within the fuel injector, a nozzle at which fuel is injected from the fuel injector in accordance with the opening and closing of said internal valve means, and filter means disposed internally of the fuel injector downstream of said fuel inlet and upstream of said valve means and comprising a filtering zone for filtering particulate material from fuel before it reaches said internal valve means, support means providing support of said filter means, said support means comprising through-hole means which is covered by said filtering zone and through which fuel passes to said internal valve means, and said filtering zone comprises a non-woven electroformed metal filter screen element that has been grown to a substantially flat uniform thickness throughout, and said filter screen element has a thickness in the range from about 50 microns to about 100 microns and a multitude of through-holes arranged in a hexagon pattern such that each is equidistant from its immediately adjacent ones, said multitude of through-holes comprises through-holes each having an area equivalent substantially to that of a 50 micron diameter circle, and said filter screen element has an open area in a range of from about 15% of its total area to about 30% of its total area.

15. A fuel injector comprising a fuel inlet at which pressurized fuel is introduced into the fuel injector, selectively energizable and de-energizable electromechanical actuator means controlling the opening and closing of an internal valve means within the fuel injector, a nozzle at which fuel is injected from the fuel injector in accordance with the opening and closing of said internal valve means, said nozzle comprising an internal shoulder that faces the direction toward which fuel is injected, and filter means disposed internally of the fuel injector downstream of said fuel inlet and upstream of said valve means for filtering particulate material from fuel before it fuel reaches said internal valve means, support means that provides downstream back-up support of said filter means, that sandwiches said filter means between itself and said internal shoulder, and that comprises through-hole means through which fuel passes after having been filtered by said filter means, said filter means comprises a filter element that is sandwiched into direct contact with said shoulder by said support means, said filter element comprises a non-woven electroformed metal filter screen element that has been grown to a substantially fiat uniform thickness throughout and is supported flat against said support means, and said filter screen element has a thickness in the range from about 50 microns to about 100 microns, has a filtering zone overlying said through-hole means and comprising a multitude of through-holes each having an area equivalent substantially to that of a 50 micron diameter circle, and said filtering zone has an open area in a range of from about 15% of its total area to about 30% of its total area.

16. A fuel injector comprising a fuel inlet at which pressurized fuel is introduced into the fuel injector, selectively energizable and de-energizable electromechanical actuator means controlling the opening and closing of an internal valve means within the fuel injector, said actuator means comprising a member that is axially reciprocated in response to the energization and de-energization of said electromechanical actuator means to open and close said valve means, a nozzle at which fuel is injected from the fuel injector in accordance with the opening and closing of said internal valve means, and filter means disposed internally of the fuel injector downstream of said fuel inlet and upstream of said valve means for filtering particulate material from fuel before it reaches said internal valve means, support means providing downstream back-up support of said filter means, said support means and said filter means comprising respective central through-holes through which said member passes, said support means comprising additional through-hole means which is covered by said filter means and through which fuel passes to said internal valve means, and said central through-hole of said support means having close running clearance to said member such that the size of said clearance imposes a substantially greater restriction to flow than the restriction imposed by said additional through-hole means so as to cause essentially all fuel flow to pass through said additional through-hole means, and said filter means comprises a filter screen element having an annular band containing a multitude of through-holes throughout, and said annular band is radially inwardly bounded by an imperforate annular inner band and radially outwardly bounded by an imperforate annular outer band.

17. A fuel injector as set forth in claim 16 in which said filter screen element has a thickness in the range from about 50 microns to about 100 microns.

18. A fuel injector as set forth in claim 16 in which said multitude of through-holes comprises through-holes each having an area equivalent substantially to that of a 50 micron diameter circle.

* * * * *